US006849993B2

(12) United States Patent
Kai et al.

(10) Patent No.: US 6,849,993 B2
(45) Date of Patent: Feb. 1, 2005

(54) DISCHARGE LAMP AND LAMP UNIT WITH CAULKING MEMBER

(75) Inventors: Makoto Kai, Osaka (JP); Makoto Horiuchi, Nara (JP); Tomoyuki Seki, Osaka (JP); Tsuyoshi Ichibakase, Osaka (JP); Mamoru Takeda, Kyoto (JP); Shinichi Yamamoto, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/870,138

(22) Filed: May 30, 2001

(65) Prior Publication Data

US 2001/0048269 A1 Dec. 6, 2001

(30) Foreign Application Priority Data

May 31, 2000 (JP) ..... 2000-162946

(51) Int. Cl.[7] ..... H01J 5/16; H01J 61/40

(52) U.S. Cl. ..... 313/113; 313/623; 313/626; 313/332; 313/570

(58) Field of Search ..... 313/623–626, 313/318.07, 113, 331, 332, 570

(56) References Cited

U.S. PATENT DOCUMENTS

| | | | | |
|---|---|---|---|---|
| 4,038,578 | A | * 7/1977 | Mathijssen | 313/623 |
| 4,874,909 | A | 10/1989 | Velke, Sr. et al. | |
| 4,940,856 | A | * 7/1990 | Bock | 446/220 |
| 5,514,835 | A | 5/1996 | Wing | |
| 5,691,601 | A | 11/1997 | Frey et al. | |
| 5,847,510 | A | * 12/1998 | Goelling et al. | 313/623 |
| 6,242,861 | B1 | * 6/2001 | Nakagawa | 313/623 |
| 6,265,817 | B1 | * 7/2001 | Steinmann et al. | 313/332 |
| 6,294,870 | B1 | * 9/2001 | Kawashima et al. | 313/623 |
| 6,335,593 | B1 | * 1/2002 | Nakagawa | 313/634 |
| 6,729,925 | B2 | * 5/2004 | Meguro et al. | 445/26 |

FOREIGN PATENT DOCUMENTS

| | | |
|---|---|---|
| CN | 1129491 A | 8/1996 |
| EP | 0 866 488 A1 | 9/1998 |
| EP | 1 003 202 A2 | 5/2000 |
| JP | 49-2381 | 1/1974 |
| JP | 04129162 A | 9/1990 |
| JP | 3-77362 | 8/1991 |
| JP | 05054701 A | 3/1993 |
| JP | 6-2547 | 1/1994 |
| JP | 06119910 A | 4/1994 |
| JP | 0869777 A | 3/1996 |
| JP | 08124529 A | 5/1996 |
| JP | 10-21881 | 1/1998 |
| JP | 10021875 A | 1/1998 |
| JP | 10-321135 | 12/1998 |
| JP | 11025917 A | 1/1999 |
| JP | 11-135021 | 5/1999 |
| JP | 2000046497 A | 2/2000 |
| JP | 2000-133039 | 5/2000 |
| TW | 388059 | 4/2000 |
| TW | 388908 | 5/2000 |
| WO | WO 95/05674 | 2/1995 |

OTHER PUBLICATIONS

European Search Report, Oct. 11, 2001, pp. 1–3.

* cited by examiner

*Primary Examiner*—Ashok Patel
(74) *Attorney, Agent, or Firm*—Harness, Dickey & Pierce, P.L.C.

(57) ABSTRACT

A discharge lamp includes a luminous bulb in which a luminous material is enclosed and a pair of electrodes are opposed to each other in the luminous bulb; and a pair of sealing portions for sealing a pair of metal foils electrically connected to the pair of electrodes, respectively. The pair of metal foils have a pair of external leads on the side opposite to the side electrically connected to the pair of electrodes, respectively. At least one of the pair of external leads is joined to a lead wire for external connection that is to be electrically connected to an external circuit by the plastic flow of a caulking member.

6 Claims, 8 Drawing Sheets

DISCHARGE LAMP AND LAMP UNIT WITH CAULKING MEMBER

BACKGROUND OF THE INVENTION

The present invention relates to a discharge lamp and a lamp unit. In particular, the present invention relates to a discharge lamp and a lamp unit used as the light source of an image projection apparatus such as a liquid crystal projector or a digital micromirror device (DMD) projector.

In recent years, an image projection apparatus such as a liquid crystal projector or a projector using a DMD has been widely used as a system for realizing large-scale screen images. A high-pressure discharge lamp having a high intensity has been commonly and widely used in such an image projection apparatus. For the light source used in the image projection apparatus, light is required to be concentrated on an imaging device included in the optical system of the projector, so that in addition to high intensity, it is also necessary to achieve a light source close to a point light source. Therefore, a short arc ultra high pressure mercury lamp that is closer to a point light and has a high intensity has been noted widely as a promising light source.

Referring to FIG. 9, a conventional short arc ultra high pressure mercury lamp 1000 will be described. FIG. 9 is a schematic view of an ultra high pressure mercury lamp 1000. The lamp 1000 includes a substantially spherical luminous bulb 110 made of quartz glass, and a pair of sealing portions (seal portions) 120 and 120' also made of quartz glass and connected to the luminous bulb 110.

A discharge space 115 is inside the luminous bulb 110. A mercury 118 in an amount of the enclosed mercury of, for example, 150 to 250 mg/cm$^3$ as a luminous material, a rare gas (e.g., argon with several tens kpa) and a small amount of halogen are enclosed in the discharge space 115. A pair of tungsten electrodes (W electrode) 112 and 112' are opposed with a certain distance D (e.g., about 1.5 mm) in the discharge space 115. Each of the W electrodes 112 and 112' includes an electrode axis (W rod) 116 and a coil 114 wound around the head of the electrode axis 116. The coil 114 has a function to reduce the temperature at the head of the electrode.

The electrode axis 116 of the W electrode 112 is welded to a molybdenum foil (Mo foil) 124 in the sealing portion 120, and the W electrode 112 and the Mo foil 124 are electrically connected by a welded portion 117 where the electrode axis 116 and the Mo foil 124 are welded. The sealing portion 120 includes a glass portion 122 extending from the luminous bulb 110 and the Mo foil 124. The glass portion 122 and the Mo foil 124 are attached tightly so that the airtightness in the discharge space 115 in the luminous bulb 110 is maintained. In other words, the sealing portion 120 is sealed by attaching the Mo foil 124 and the glass portion 122 tightly for foil-sealing. The sealing portions 120 have a circular cross section, and the rectangular Mo foil 124 is disposed in the center of the inside of the sealing portion 120.

The Mo foil 124 of the sealing portion 120 includes an external lead (Mo rod) 130 made of molybdenum on the side opposite to the side on which the welded portion 117 is positioned. The Mo foil 124 and the external lead 130 are welded to each other so that the Mo foil 124 and the external lead 130 are electrically connected at a welded portion 132. The structures of the W electrode 112' and sealing portion 120' are the same as those of the W electrode 112 and sealing 120, so that description thereof will be omitted.

Next, the operational principle of the lamp 1000 will be described. When a start voltage is applied to the W electrodes 112 and 112' via the external leads 130 and the Mo foils 124, discharge of argon (Ar) occurs. Then, this discharge raises the temperature in the discharge space 115 of the luminous bulb 110, and thus the mercury 118 is heated and evaporated. Thereafter, mercury atoms are excited and become luminous in the arc center between the W electrodes 112 and 112'. The higher the mercury vapor pressure of the lamp 1000 is, the higher the emission efficiency is, so that the higher mercury vapor pressure is suitable as a light source for an image projection apparatus. However, in view of the physical strength against pressure of the luminous bulb 110, the lamp 1000 is used at a mercury vapor pressure of 15 to 25 MPa.

As shown in FIG. 10, the lamp 1000 can be formed into a lamp unit 1200 in combination with a reflecting mirror 60. The lamp unit 1200 includes the discharge lamp 1000 and the reflecting mirror 60 for reflecting light emitted from the discharge lamp 1000, and the light emitted from the discharge lamp 1000 is reflected at the reflecting mirror 60 and emits in the emission direction 50. The reflecting mirror 60 has a front opening **60*a* on the side of the emission direction 50. A front glass (not shown)is to be attached at the front opening 60*a*** for the purpose of preventing scattering at the time of lamp breakage.

A lead wire 65 is electrically connected to the external lead 130 of the sealing portion 120 positioned on the front opening **60*a* side. The lead wire 65 for external connection is formed of, for example, a Ni—Mn alloy, and extends from the junction 131 with the external lead 130 to the outside of the reflecting mirror 60 through an opening 62 for a lead wire so as to be electrically connected to an external circuit (e.g., ballast). A lamp base 55 is attached to the other sealing portion 120' of the discharge lamp 1000, and the sealing portion 120' is attached to the reflecting mirror 60**.

To electrically connect the external lead 130 of the sealing portion 120 to the lead wire 65 for external connection, the first approach that one can come up with is to simply wind the lead wire 65 for external connection around the external lead 130. However, the approach of simply winding is not sufficient for electrical connection (electrical conductivity) between the lead wire 65 for external connection and the external lead 130 because the lead wire 65 and the external lead 130 are not welded. Therefore, it is possible that discharge occurs at the junction 131, and therefore it is not preferable to use this approach to join the lead wire 65 for external connection 130. Thus, the external lead 130 and the lead wire 65 for external connection in the lamp unit 1200 are joined by welding.

Molybdenum constituting the external lead 130 has the property of being recrystallized at high temperatures and becoming fragile, and therefore it is technically difficult for the external lead 130 and the lead wire 65 for external connection to be joined directly by welding. Therefore, the external lead 130 and the lead wire 65 for external connection are welded at a low temperature in the following manner, as shown in FIG. 11. First, a sleeve (cylinder) 140 made of Ni is placed in such a manner that the sleeve 140 is in contact with the outer circumference of the junction 131 of the external lead 130, and then the external lead 130 and the sleeve 140 are welded at a relatively low temperature. Then, the sleeve 140 and the lead wire 65 for external connection made of a Ni—Mn alloy are welded. Thus, it is possible to electrically connect the external lead 130 and the lead wire 65 for external connection while preventing the external lead 130 from being fragile.

However, the welding portion 142 between the sleeve 140 and the lead wire 65 for external connection is formed by point welding, so that the contact area is small (almost a point contact). Therefore, when stress is applied to the lead wire 65 for external connection, the lead wire 65 for external connection is easily dropped off from the junction 131. In particular, when assembling the lamp unit 1200, it is necessary to pass the lead wire 65 for external connection through the opening 62 for a lead wire of the reflecting mirror 60. Therefore, stress is easily applied to the lead wire 65 for external connection, and the lead wire 65 for external connection is often dropped off. Furthermore, the welded portion 144 between the external lead 130 and the sleeve 140 also is formed by point welding. Therefore, if stress is applied to the sleeve 140, the sleeve 140 may be moved, and the welded members may be detached so that the sleeve 140 may be dropped off. Therefore, in the conventional lamp unit 1200, the reliability in the connection between the external lead 130 and the lead wire 65 for external connection is not good.

In the past, the lamp lifetime was comparatively short, so that even if the reliability in the connection between the external lead 130 and the lead wire 65 for external connection is poor to some extent, this drawback alone rarely causes a big problem. However, nowadays when the lamp lifetime has been prolonged to, for example, 2000 hours or more because of improvement of production techniques or the like, it is important to improve the reliability in the connection between the external lead 130 and the lead wire 65 for external connection, and this problem of the connection reliability is expected to become serious.

SUMMARY OF THE INVENTION

Therefore, with the foregoing in mind, it is an object of the present invention to provide a discharge lamp having improved reliability in the connection between the external lead and the lead wire for external connection.

A discharge lamp of the present invention includes a luminous bulb in which a luminous material is enclosed and a pair of electrodes are opposed to each other in the luminous bulb; and a pair of sealing portions for sealing a pair of metal foils electrically connected to the pair of electrodes, respectively. The pair of metal foils have a pair of external leads on the side opposite to the side electrically connected to the pair of electrodes, respectively. At least one of the pair of external leads is joined to a lead wire for external connection that is to be electrically connected to an external circuit by plastic flow of a caulking member.

In one embodiment of the present invention, the caulking member has a cylindrical shape.

In one embodiment of the present invention, each of the pair of external leads is formed of molybdenum, and the caulking member is formed of a softer material than the molybdenum constituting the external leads.

It is preferable that the caulking member is formed of a material having excellent oxidation resistance properties.

Another discharge lamp of the present invention includes a luminous bulb in which a luminous material is enclosed and a pair of electrodes are opposed to each other in the luminous bulb; and a pair of sealing portions for sealing a pair of metal foils electrically connected to the pair of electrodes, respectively. The pair of metal foils have a pair of external leads on the side opposite to the side electrically connected to the pair of electrodes, respectively. At least one of the external leads and a lead wire for external connection that is to be electrically connected to an external circuit are integrally formed.

A lamp unit of the present invention includes the above-described discharge lamp, and a reflecting mirror for reflecting light emitted from the discharge lamp.

A method for producing a lamp unit of the present invention includes the steps of: preparing a discharge lamp provided with a pair of external leads, a lead wire for external connection that is to be electrically connected to an external circuit, and a reflecting mirror having an opening for a lead wire for passing the lead wire for external connection through and a front opening positioned forward in the emission direction; joining one of the pair of external leads and the lead wire for external connection; inserting the discharge lamp into the reflecting mirror from the front opening of the reflecting mirror; drawing out the lead wire for external connection jointed to the external lead from the inside of the reflecting mirror to the outside of the reflecting mirror through the opening for a lead wire of the reflecting mirror; and fixing the discharge lamp to the reflecting mirror.

Another method for producing a lamp unit of the present invention includes the steps of: preparing a discharge lamp provided with a pair of external leads, a lead wire for external connection that is to be electrically connected to an external circuit, and a reflecting mirror having an opening for a lead wire for passing the lead wire for external connection through and a front opening positioned forward in the emission direction; passing the lead wire for external connection through the opening for a lead wire of the reflecting mirror; inserting the discharge lamp into the reflecting mirror from the front opening of the reflecting mirror; joining one of the pair of external leads and the lead wire for external connection passing through the opening for a lead wire; and fixing the discharge lamp to the reflecting mirror.

In one embodiment of the present invention, the method for producing a lamp unit further includes the step of attaching a front glass to the front opening of the reflecting mirror, after fixing the discharge lamp to the reflecting mirror.

It is preferable that the joining step is performed by caulking the one of the pair of external leads and the lead wire for external connection.

According to the discharge lamp of the present invention, the external lead and the lead wire for external connection are jointed by the plastic flow of a caulking member, so that multiple point contact can be achieved. As a result, the reliability in the connection between the external lead and the lead wire for external connection can be improved. Furthermore, according to another discharge lamp, the external lead and the lead wire for external connection are integrally formed, so that there is no junction therebetween. Thus, the reliability in the connection between the external lead and the lead wire for external connection can be improved.

According to the discharge lamp of the present invention, the external lead and the lead wire for external connection are joined by the plastic flow of the caulking member, so that the reliability in the connection between the external lead and the lead wire for external connection can be improved. Furthermore, according to another discharge lamp, the external lead and the lead wire for external connection are integrally formed, so that the reliability in the connection between the external lead and the lead wire for external connection can be improved. According to a method for producing a lamp unit of the present invention, after the discharge lamp is inserted into the reflecting mirror from the front opening of the reflecting mirror, the discharge lamp is fixed to the reflecting mirror. Therefore, the lamp unit can be produced by a simplified work process.

This and other advantages of the present invention will become apparent to those skilled in the art upon reading and understanding the following detailed description with reference to the accompanying figures.

DETAILED DESCRIPTION OF THE INVENTION

Figure 1A:
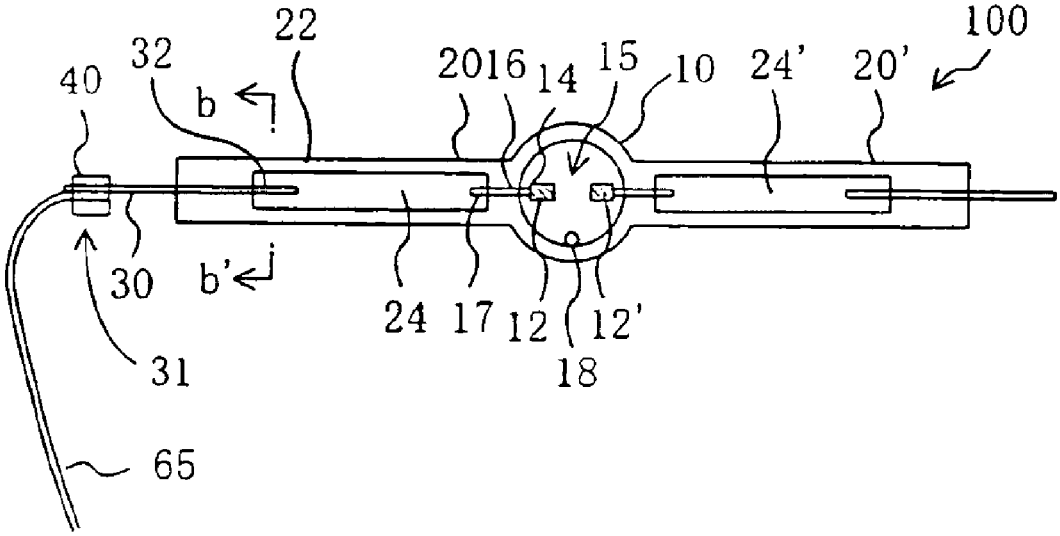
FIG. 1A is a schematic top view showing the structure of a discharge lamp 100 of Embodiment 1.

Hereinafter, embodiment of the present invention will be described with reference to the accompanying drawings. In the following drawings, for simplification, the elements having substantially the same functions bear the same reference numeral.

Embodiment 1

Figure 1B:
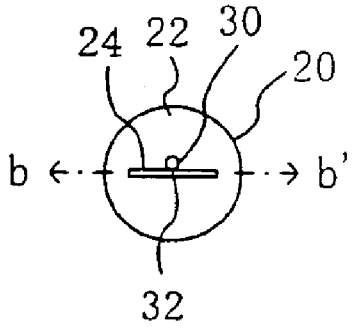
FIG. 1B is a cross-sectional view taken along line b–b' of FIG. 1A.
Figure 2:
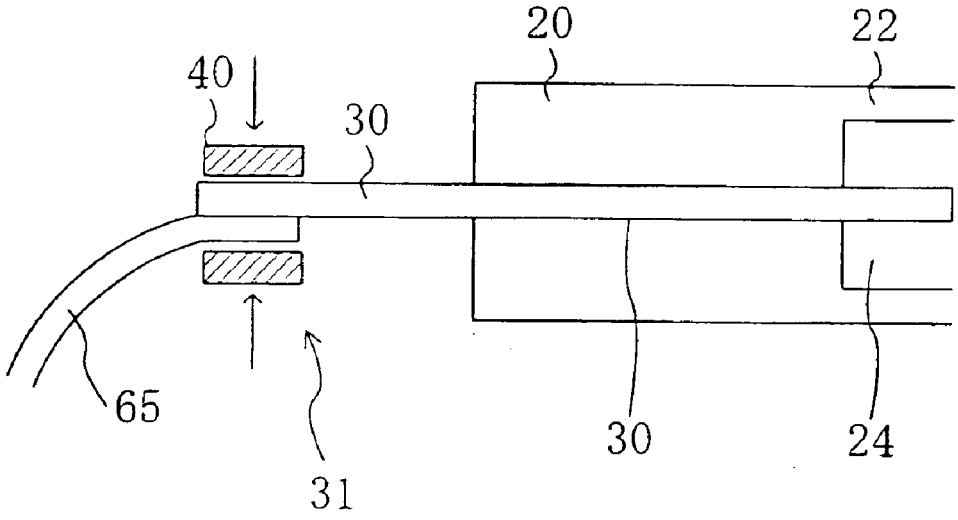
FIG. 2 is a partial enlarged view of a junction 31.
Figure 3:
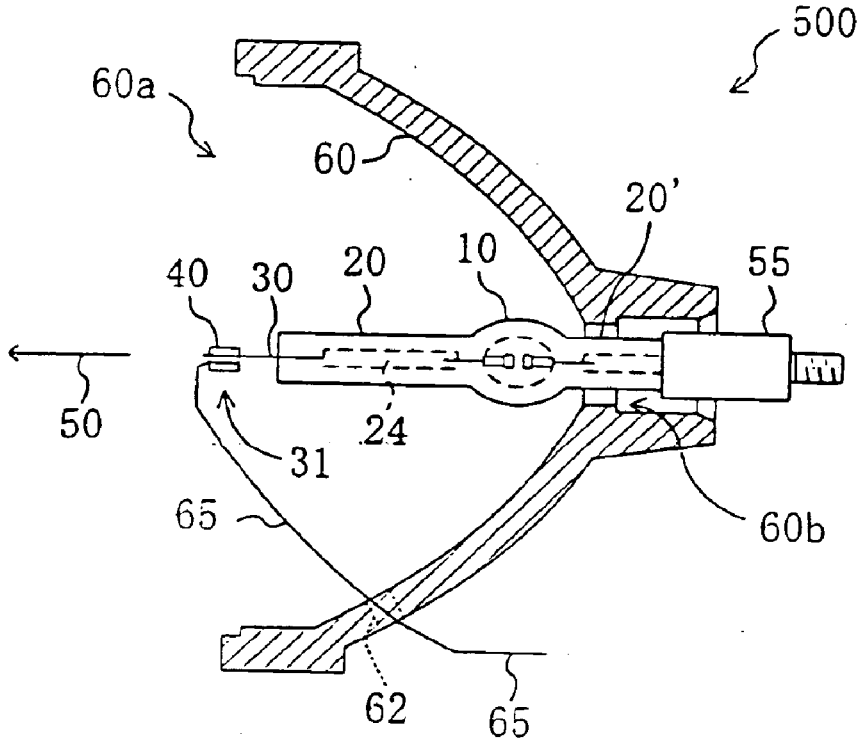
FIG. 3 is a schematic cross-sectional view showing the structure of a lamp unit 500.

Embodiment 1 of the present invention will be described with reference to FIGS. 1 to 3. FIG. 1A is a schematic top view showing the structure of a discharge lamp 100 of this embodiment. FIG. 1B is a cross-sectional view taken along line b–b' of FIG. 1A.

The discharge lamp 100 of Embodiment 1 includes a luminous bulb 10, and a pair of sealing portions 20 and 20' connected to the luminous bulb 10. A discharge space 15 in which a luminous material 18 is enclosed is inside the luminous bulb 10. A pair of electrodes 12 and 12' are opposed to each other in the discharge space 15. The luminous bulb 10 is made of quartz glass and is substantially spherical. The outer diameter of the luminous bulb 10 is, for example, about 5 mm to 20 mm. The glass thickness of the luminous bulb 10 is, for example, about 1 mm to 5 mm. The volume of the discharge space 15 in the luminous bulb 10 is, for example, about 0.01 to 1 cc. In this embodiment, the luminous bulb 10 having an outer diameter of about 13 mm, a glass thickness of about 3 mm, a volume of the discharge space 15 of about 0.3 cc is used. As the luminous material 18, mercury is used. For example, about 150 to 200 mg /$cm^3$ of mercury, a rare gas (e.g., argon) with 5 to 20 kPa, and a small amount of halogen are enclosed in the discharge space 15. In FIG. 1A, mercury 18 attached to the inner wall of the luminous bulb 10 is schematically shown.

The pair of electrodes 12 and 12' in the discharge space 15 is arranged with a gap (arc length) of, for example, about 1 to 5 mm. As the electrodes 12 and 12', for example, tungsten electrodes (W electrodes) are used. In this embodiment, the W electrodes 12 and 12' are arranged with a gap of about 1.5 mm. A coil 14 is wound around the head of each of the electrodes 12 and 12'. The coil 14 has a function to lower the temperature of the electrode head. The electrode axis (W rod) 16 of the electrode 12 is electrically connected to the metal foil 24 in the sealing portion 20. Similarly, the electrode axis 16 of the electrode 12' is electrically connected to the metal foil 24' in the sealing portion 20'.

The sealing portion 20 includes a metal foil 24 electrically connected to the electrode 12 and a glass portion 22 extending from the luminous bulb 10. The airtightness in the discharge space 15 in the luminous bulb 10 is maintained by the foil-sealing between the metal foil 24 and the glass portion 22. The glass portion 22 of the sealing portion 20 is made of quartz glass, for example. The metal foil 24 is a molybdenum foil (Mo foil), for example, and has a rectangular shape, for example. As shown in FIG. 1B, the sealing portion 20 has a circular cross section, and the rectangular Mo foil 24 is disposed in the center of the inside of the sealing portion 20. The Mo foil 24 in the sealing portion 20 is joined to the electrode 12 by welding, and the Mo foil 24 includes an external lead 30 on the side opposite to the side on which the electrode 12 is connected. The external lead 30 is formed of, for example, molybdenum, and is connected to the Mo foil 24, for example, by welding. The structure of the sealing portion 20' is the same as that of sealing 20, so that description thereof will be omitted.

The external lead 30 is electrically connected to a lead wire 65 for external connection that is electrically connected to an external circuit (e.g., a ballast). The external lead 30 is jointed to the lead wire 65 for external connection that is formed of, for example, a Ni—Mn alloy at a junction 31 by the plastic flow of a caulking member 40. As shown in an enlarged view of FIG. 2, the external lead 30 and the lead wire 65 for external connection are caulked by applying stress from the outside of the caulking member 40. Therefore, the external lead 30 and the lead wire 65 for external connection are joined, not by welding, but by the plastic flow of the caulking member 40. The caulking member 40 is a sleeve having a cylindrical shape before plastic deformation, for example. In this embodiment, the caulking member 40 is a cylindrical member having an inner diameter larger than the outer diameter of the external lead 30.

Since molybdenum itself constituting the external lead 30 is a material that is difficult to plastically deform, it is preferable that the caulking member 40 is formed of a softer material than molybdenum. Examples of such a material include Al, Cu, and Ni. Furthermore, since the caulking member 40 is positioned in a portion that is easily heated by the light of the lamp or the contact resistance of current, it is preferable that the caulking member 40 is formed of a material having excellent oxidation resistance properties (e.g., Al) for the purpose of improving the reliability of the lamp.

In this embodiment, in the case where the outer diameter of the external lead 30 is about 0.6 mm, a cylindrical caulking member 40 (longitudinal length of about 3 mm)

formed of Al having an inner diameter of about 1.2 mm (thickness of about 0.2 mm) is used. Since it is sufficient that joining can be achieved by the plastic flow of the caulking member 40, it is possible to use not only the cylindrical caulking member 40 used in this embodiment, but also, for example a U-shaped caulking member or a caulking member constituted by two plates.

Figure 11:
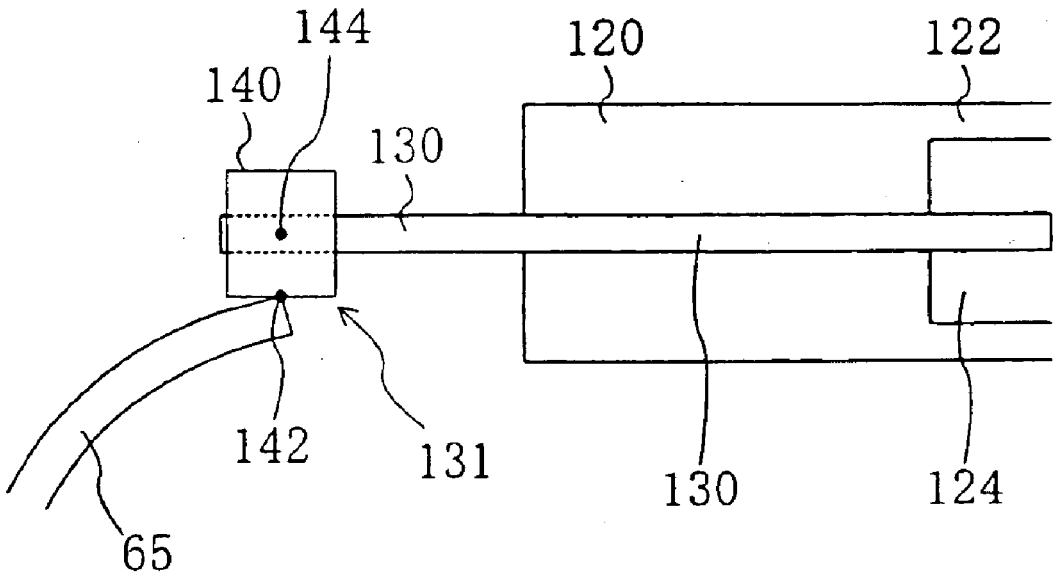
FIG. 11 Prior Art
FIG. 11 is a partial enlarged view of a junction 131.

In the discharge lamp 100 of this embodiment, the external lead 30 and the lead wire 65 for external connection are joined by the plastic flow of the caulking member 40, so that the external lead 30 is in contact with the lead wire 65 for external connection at multiple points for electrical connection. Therefore, the reliability in the connection between the external lead 30 and the lead wire 65 for external connection can be improved from the prior art. In other words, the mechanical strength of the lamp 100 of this embodiment at the junction 31 can be higher than that of the conventional structure (see FIG. 11) where the external lead 30 is in point contact with the sleeve 140 and the sleeve 140 is in point contact with the lead wire 65 for external connection.

Furthermore, since the external lead 30 is in contact with the lead wire 65 for external connection at multiple points, the contact resistance between the external lead 30 and the lead wire 65 for external connection can be smaller than that in the conventional structure. Therefore, the temperature at the junction 31 during lamp operation can be low, which also can improve the reliability of the lamp. Furthermore, since the external lead 30 and the lead wire 65 for external connection are firmly joined by the plastic flow of the caulking member 40, unlike the approach of simply winding the lead wire for external connection around the external lead, insufficiency of electrical connection (electrical conductivity) between the lead wire 65 for external connection and the external lead 30 can be avoided. In the structure of this embodiment, the connection reliability can be ensured to some extent beforehand, and therefore inspection as to whether or not electrical connection is satisfactory, which is performed when joined by welding, can be eliminated in the production process. As a result, the production cost can be reduced.

The discharge lamp 100 of this embodiment can be formed into a lamp unit in combination with a reflecting mirror. FIG. 3 is a schematic cross-sectional view of a lamp unit 500 including the discharge lamp 100 of this embodiment.

The lamp unit 500 includes the discharge lamp 100 including the external lead 30 joined to the lead wire 65 for external connection by the plastic flow of the caulking member 40, and a reflecting mirror 60 for reflecting light emitted from the discharge lamp 100. One sealing 20 is positioned on the front opening 60*a* side (emission direction 50 side) of the reflecting mirror 60, and the other sealing portions 20' is fixed to the reflecting mirror 60.

The caulking member 40 is provided at the junction 31 in the external lead 30 of the sealing portion 20 positioned on the front opening 60*a* side of the reflecting mirror 60, and the external lead 30 and the lead wire 65 for external connection are joined by the plastic deformation of the caulking member 40 for electrical connection. The lead wire 65 for external connection joined to the external lead 30 at the junction 31 extends to the outside of the reflecting mirror 60 through an opening 62 for a lead wire of the reflecting mirror 60. The lead wire 65 for external connection extending to the outside of the reflecting mirror 60 is electrically connected to an external circuit (not shown) such as a ballast.

It is preferable to provide the opening 62 for a lead wire for passing the lead wire 65 for external connection through in a position where no excessive tension is applied to the lead wire 65 for external connection joined to the external lead 30. When the lead wire 65 for external connection is provided in such a position, the reliability in the connection between the external lead 30 and the lead wire 65 for external connection can be improved further. As described above, in this embodiment, the opening 62 for a lead wire is provided in such a position that no excessive tension is applied to the lead wire 65 for external connection. In addition to that, the opening 62 for a lead wire is provided in such a position that no adverse optical effect is caused to the reflecting mirror 60 so as not to deteriorate the optical characteristics of the lamp. Furthermore, the opening 62 for a lead wire is provided in such a position that the strength of the reflecting mirror 60 can be maintained so as not to lower the strength of the lamp unit.

It is also preferable to fix the lead wire 65 for external connection in a position of the opening 62 for a lead wire with, for example, metal fittings. Fixing the lead wire 65 for external connection in the position of the opening 62 for a lead wire makes it difficult for vibration to propagate to the junction 31 when the vibration occurs in the lamp unit 500. Therefore, a reduction in the strength of the lead wire 65 for external connection at the junction 31 can be prevented.

Figure 4:
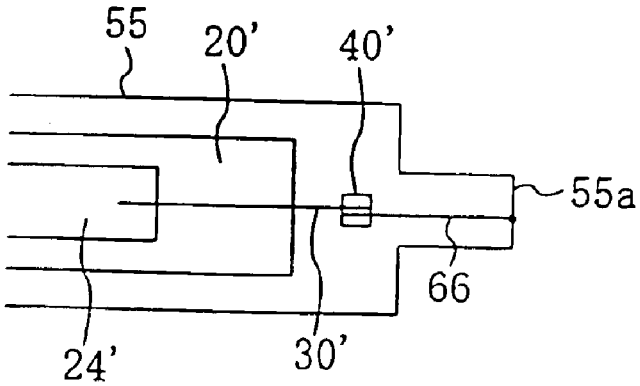
FIG. 4 is a schematic cross-sectional view showing the internal structure of a lamp base 55.

The other sealing portion 20' is passed through a rear opening 60*b* of the reflecting mirror 60, and a lamp base 55 is attached to the end of the sealing portion 20'. FIG. 4 is a schematic view showing the internal structure of the lamp base 55. As shown in FIG. 4, the external lead 30' extending from the end of the sealing portion 20' is electrically connected to the lamp base 55. The electrical connection between the external lead 30' and the lamp base 55 can be established by caulking the external lead 30' positioned in the lamp base 55 and a lead wire 66 for external connection (e.g., Ni—Mn wire) with a caulking member 40' formed of, for example, Ni, as shown in FIG. 4. One end of the lead wire 66 is welded to an end 55*a* of the lamp base 55.

The mechanical strength can be ensured to some extent, because there is less influence of the temperature on the lamp base 55 side than on the front opening 60*a* during lamp operation, and the external lead 30' positioned on the lamp base 55 is received in the lamp based 55. Therefore, electrical connection between the external lead 30' and the lamp base 55 can be established, not only by using the caulking member 40', but also by welding the lead wire 66 for external connection to the external lead 30' of the lamp base 55. The lead wire 66 for external connection and the external lead 30' can be welded by welding the external lead 30' to a sleeve and then welding the sleeve to the lead wire 66 for external connection. Alternatively, the lead wire 66 for external connection (e.g., Ni wire ) and the external lead 30' (e.g., Mo rod) can be welded directly.

The sealing portion 20' and the reflecting mirror 60 are attached, for example, with an inorganic adhesive (e.g., cement) to be integrated. The reflecting mirror 60 attached to the sealing portion 20' is designed to reflect the radiated light from the mercury lamp 100 such that the light becomes, for example, a parallel luminous flux, a focused luminous flux converged on a predetermined small area, or a divergent luminous flux equal to that emitted from a predetermined small area. The reflecting mirror 60 is designed and processed with a very high precision so as not to degrade the optical characteristics of the lamp. As the reflecting mirror 60, a parabolic reflector or an ellipsoidal mirror can be used, for example. A front glass (not shown) can be attached to the front opening 60*a* of the reflecting mirror 60 for the purpose of preventing scattering at the time of lamp breakage.

In the lamp unit 500 in this embodiment, the lead wire 65 for external connection and the external lead 30 of the sealing portion 20 positioned on the front opening 60*a* of the reflecting mirror 60 that is heated to a high temperature during lamp operation are joined by the plastic deformation of the caulking member 40. Therefore, the reliability in the connection between the external lead 30 and the lead wire 65 for external connection can be improved from the prior art. As a result, the reliability of the operation of the lamp unit during lamp operation can be improved.

Figure 5:
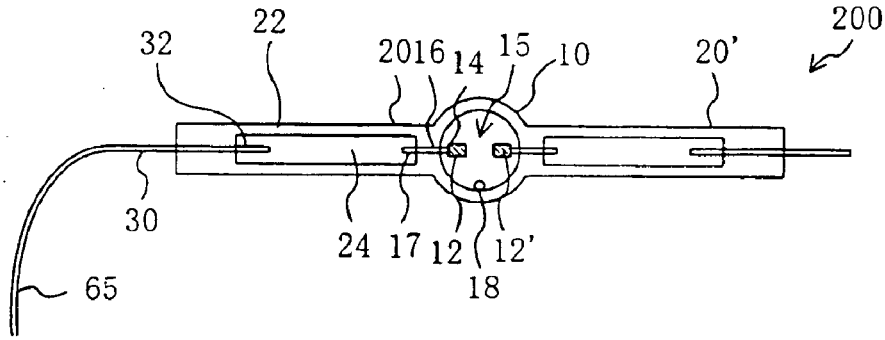
FIG. 5 is a schematic cross-sectional view showing a discharge lamp 200 of Embodiment 1.
Figure 6:
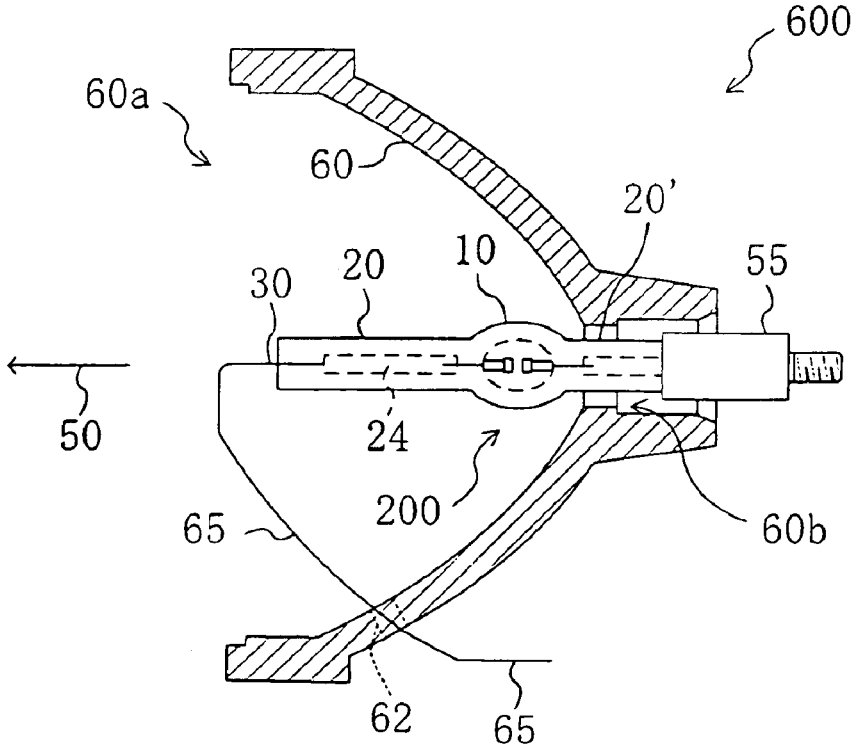
FIG. 6 is a schematic cross-sectional view showing the structure of a lamp unit 600.

In the lamp unit 500 of this embodiment, the lamp 100 in which the external lead 30 and the lead wire 65 for external connection are joined by the plastic flow of the caulking member 40 is used as the discharge lamp. Alternatively, a lamp 200 in which at least one external lead 30 and the lead wire 65 for external connection are integrally formed as shown in FIG. 5 also can be used.

The lamp 200 has a structure where the external lead (e.g., molybdenum rod) 30 also acts as the lead wire 65 for external connection. When the lamp 200 and the reflecting mirror 60 are combined to form a lamp unit 600, as shown in FIG. 5, the external lead 30 extends from one end of the metal foil 24 and becomes the lead wire 65 for external connection, and then passes through the opening 62 for a lead wire of the reflecting mirror 60 and goes out of the reflecting mirror 60. In the case of the lamp 200, the external lead 30 and the lead wire 65 for external connection are integrally formed, so that there is no junction between the external lead 30 and the lead wire 65 for external connection. Therefore, in the case of this structure, the reliability in the connection between the external lead 30 and the lead wire 65 for external connection can be improved from the prior art. In the case where both the external lead 30 and the lead wire 65 for external connection are formed of molybdenum, it is preferable to provide the opening 62 for a lead wire of the reflecting mirror 60 in such a position that no excessive stress is applied to the lead wire 65 for external connection, because molybdenum is a comparatively hard material.

The lamp units 500 and 600 of this embodiment can be attached to an image projection apparatus such as a liquid crystal projector or a projector using a DMD, and is used as the light source for projectors. The discharge lamp and the lamp unit of the above embodiment can be used, not only as the light source for image projection apparatuses, but also as a light source for ultraviolet steppers, or a light source for an athletic meeting stadium, a light source for headlights of automobiles or the like.

Embodiment 2

Figure 7A:
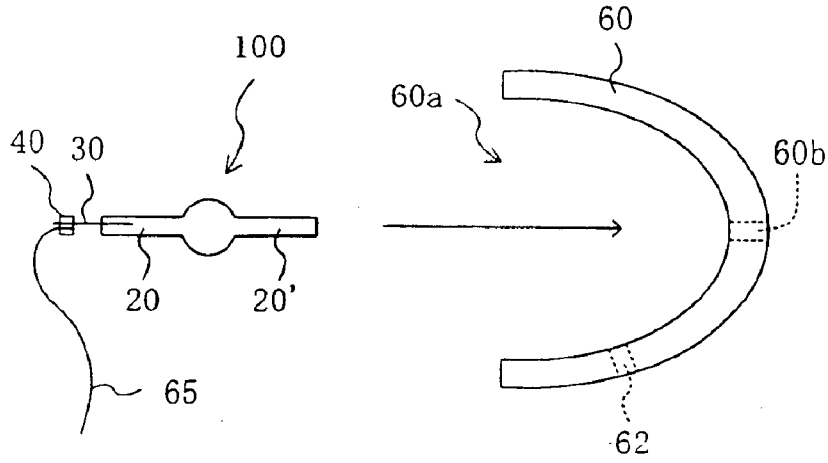
FIGS. 7A to 7C are cross sectional views for illustrating the process sequence of a method for producing a lamp unit of Embodiment 2.
Figure 7B:
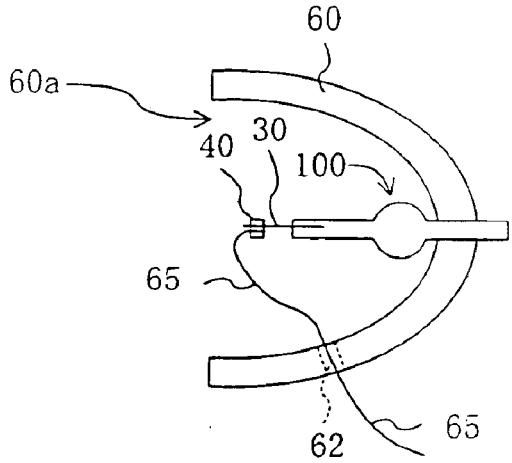
Figure 7C:
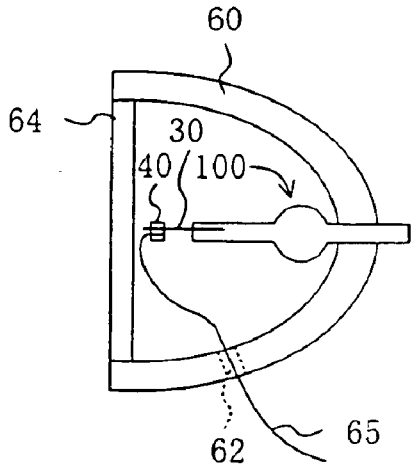

Embodiment 2 of the present invention will be described with reference to FIGS. 7A to 7C. FIGS. 7A to 7C are schematic views showing processes of a method for producing a lamp unit.

First, a discharge lamp having a pair of external leads 30, a lead wire 65 for external connection and a reflecting mirror 60 are prepared. The prepared discharge lamp has the same structure as that of the lamp 100 except that the caulking member 40 and the lead wire 65 for external connection are not provided. The reflecting mirror 60 includes a front opening 60*a* formed forward in the emission direction and an opening 62 for a lead wire for passing the lead wire 65 for external connection through.

Next, as shown in FIG. 7A, the external lead 30 of the discharge lamp and the lead wire 65 for external connection are caulked with the caulked member 40, so that the lamp 100 of Embodiment 1 is produced, and then the lamp 100 is inserted into the reflecting mirror 60 from the front opening 60*a* of the reflecting mirror 60.

Next, as shown in FIG. 7B, the lead wire 65 for external connection joined to the external lead 30 is drawn out from the inside of the reflecting mirror 60 through the opening 62 for a lead wire. Then, the lamp 100 is fixed to the reflecting mirror 60. Thereafter, as shown in FIG. 7C, a front glass 64 is attached to the front opening 60*a* of the reflecting mirror 60.

According to this embodiment, the lamp 100 is inserted into the reflecting mirror 60 from the front opening 60*a*, as shown in FIG. 7A. This is a simplified manner, compared with, for example, the manner in which the size of the rear opening 60*b* of the reflecting mirror 60 is enlarged to such a size that the luminous tube 10 of the lamp 100 can pass through the opening, and then the lamp 100 is introduced into the reflecting mirror 60 from the rear of the reflecting mirror 60 (rear in the emission direction). Thus, the working efficiency can be improved. Furthermore, a portion positioned in the vicinity of the rear opening 60*b* of the reflecting mirror 60 is immediately behind the lamp 100, so that this portion reflects light emitted from the lamp 100 more effectively than other portions. Therefore, enlarging the size of the rear opening 60*b* results in a reduction of the luminous flux emitted from the lamp unit. In the case where the lamp 100 is inserted into the reflecting mirror 60 from the front opening 60*a*, as shown in FIG. 7A, the size of the rear opening 60*b* can be reduced to the size of the outer diameter of the sealing portion 20', so that the reduction of the luminous flux emitted from the lamp unit can be suppressed.

Furthermore, as shown in FIG. 7B, when the lead wire 65 for external connection is drawn out from the inside 61 to the outside 63 of the reflecting mirror 60 through the opening 62 for a lead wire, the lamp unit can be produced without applying excessive onto the lead wire 65 for external connection (and junction 31). Furthermore, according to this embodiment, as shown in FIG. 7C, the front glass 64 is attached at the last stage of the production process of the lamp unit, so that the working efficiency can be higher than when work continues after the front glass 64 is attached in the middle of the production process. According to the production method of this embodiment, the lamp unit can be produced without applying excessive tension to the junction 31. Therefore, the present invention can be used preferably, when producing a lamp unit including a lamp having the structure where the external lead 30 and the lead wire 65 for external connection are caulked, but also a lamp unit including a lamp having a structure where the external lead 30 and the lead wire 65 for external connection are joined by, for example welding as in the prior art.

Figure 8A:
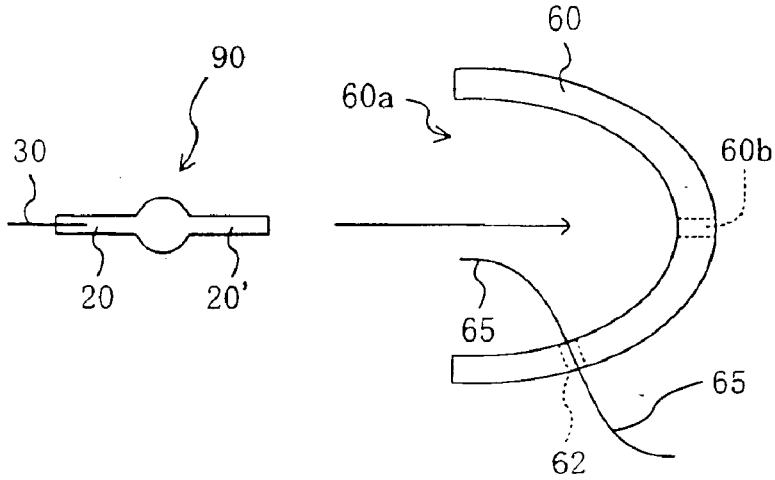
FIGS. 8A to 8C are cross sectional views for illustrating the process sequence of another method for producing a lamp unit of Embodiment 2.
Figure 8B:
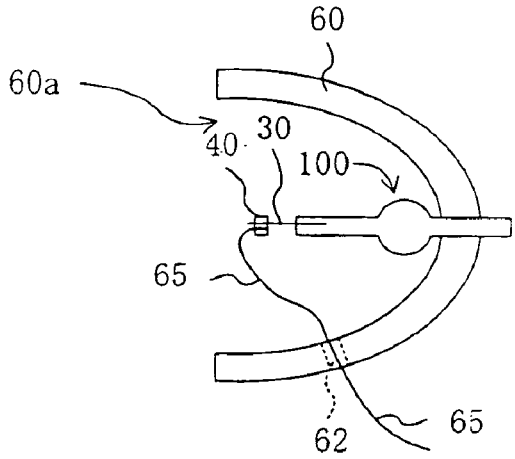
Figure 8C:
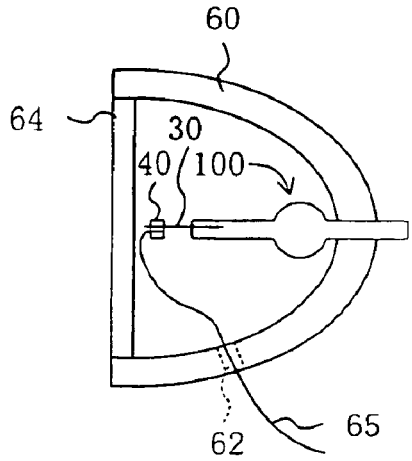
Figure 9:
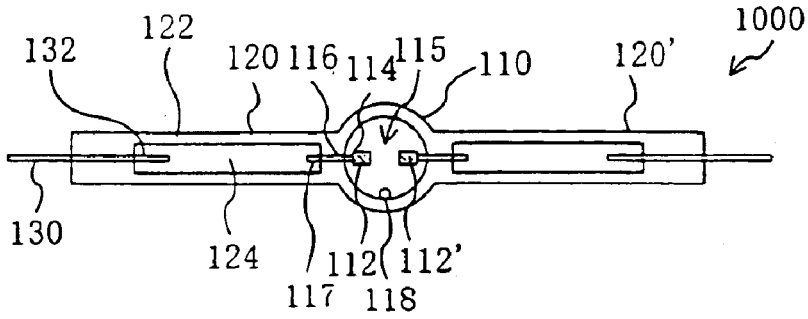
FIG. 9 Prior Art
FIG. 9 is a schematic view showing the structure of a conventional discharge lamp 1000.
Figure 10:
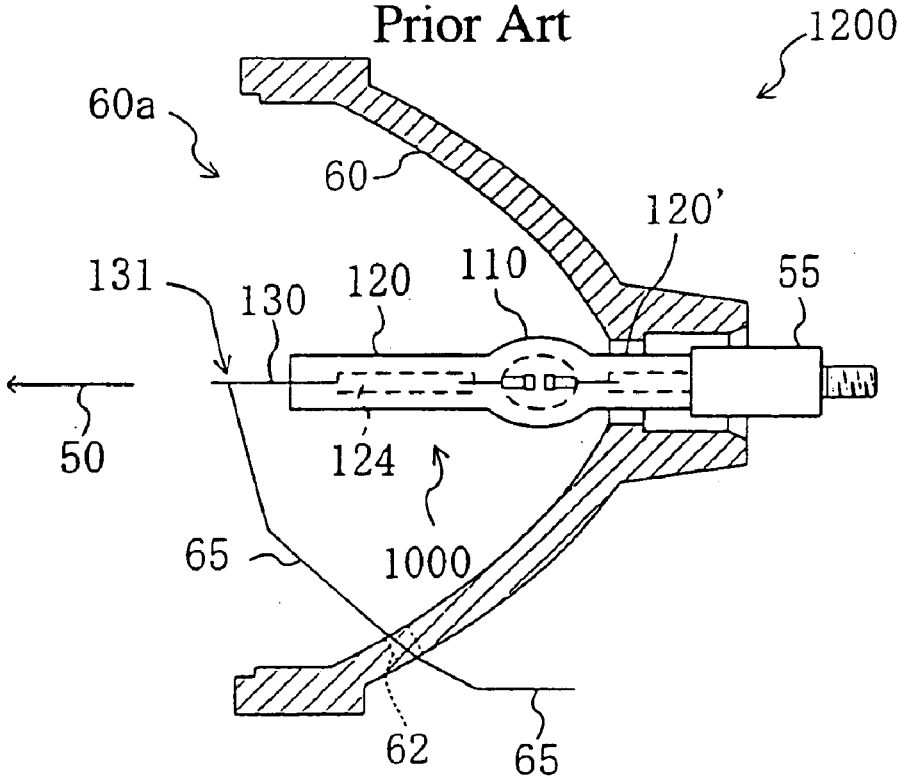
FIG. 10 Prior Art
FIG. 10 is a schematic view showing the structure of a conventional lamp unit 1200.

A lamp unit also can be produced in the manner as shown in FIGS. 8A to 8C.

First, a discharge lamp 90 having a pair of external leads 30, a lead wire 65 for external connection and a reflecting mirror 60 are prepared. The prepared discharge lamp has the same structure as that of the lamp 100 except that the caulking member 40 and the lead wire 65 for external connection are not provided.

Next, as shown in FIG. 8A, after the lead wire 65 for external connection is passed through the opening 62 for a lead wire of the reflecting mirror 60, and then the discharge lamp 90 is inserted into the reflecting mirror 60 from the front opening 60*a* of the reflecting mirror 60. It is off course possible to insert the discharge lamp 90 into the reflecting mirror 60, and then pass the lead wire 65 for external connection through the opening 62 for a lead wire.

Next, as shown in FIG. 8B, the external lead 30 and a lead wire 65 for external connection passing through the opening 62 for a lead wire are joined to each other in the reflecting mirror 60. It is preferable that the external lead 30 and a lead wire 65 for external connection are joined by caulking the former and the latter with a caulking member 40. Then, the sealing portion 20' of the lamp is fixed to the reflecting mirror 60. Alternatively, it is possible to fix the sealing portion 20' of the lamp to the reflecting mirror 60, and then join the external lead 30 and a lead wire 65 for external connection. Finally, as shown in FIG. 8C, a front glass is attached to the front opening 60*a* of the reflecting mirror 60.

The production method shown in FIGS. 8A to 8C also can improve the work efficiency and prevent the optical characteristics of the lamp unit from deteriorating, for example, compared with a method for producing a lamp unit including forming a large rear opening 60*b* and introducing a lamp from the rear of the reflecting mirror 60.

Other Embodiments

In the above embodiments, mercury lamps employing mercury as the luminous material have been described as an example of the discharge lamp of the present invention. However, the present invention can apply to any discharge lamps in which the airtightness of the luminous tube is maintained by the sealing portion (seal portion). For example, the present invention can apply to a discharge lamp enclosing a metal halide such as a metal halide lamp.

Furthermore, in the above embodiments, the case where the mercury vapor pressure is about 20 MPa (the case of so-called ultra high pressure mercury lamp) has been described. However, the present invention can apply to a high pressure mercury lamp where the mercury vapor pressure is about 1 MPa or a low pressure lamp where the mercury vapor pressure is about 1 kPa. Furthermore, the lamp can be of a short arc type where the gap (arc length) between the pair of electrodes 12 and 12' can be short, or the gap can be longer than that. The discharge lamps of the above embodiments can be used by either alternating current lighting or direct current lighting.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp comprising:

a luminous bulb in which a luminous material is enclosed and a pair of electrodes are opposed to each other in the luminous bulb; and a pair of sealing portions for sealing a pair of metal foils electrically connected to the pair of electrodes, respectively;

wherein the pair of metal foils have a pair of external leads on a side opposite to a side electrically connected to the pair of electrodes, respectively, at least one of the pair of external leads is joined to a lead wire for external connection that is to be electrically connected to an external circuit by plastic flow of a caulking member, the caulking member is composed of aluminum or copper.

2. The discharge lamp of claim 1, wherein the caulking member has a cylindrical shape.

3. The discharge lamp of claim 1, wherein each of the pair of external leads is formed of molybdenum, and the caulking member is formed of a softer material than the molybdenum constituting the external leads.

4. The discharge lamp of claim 3, wherein the caulking member is formed of a material having excellent oxidation resistance properties.

5. The discharge lamp of claim 1, wherein the caulking member is composed of aluminum.

6. A lamp unit comprising the discharge lamp of claim 1, and a reflecting mirror for reflecting light emitted from the discharge lamp.

* * * * *

UNITED STATES PATENT AND TRADEMARK OFFICE

CERTIFICATE OF CORRECTION

PATENT NO. : 6,849,993 B2
DATED : February 1, 2005
INVENTOR(S) : Makoto Kai et al.

It is certified that error appears in the above-identified patent and that said Letters Patent is hereby corrected as shown below:

Column 12,
Line 24, after "member" first occurrence delete "," and insert -- by applying stress from the outside of the caulking member, --

Signed and Sealed this

Ninth Day of August, 2005

JON W. DUDAS
*Director of the United States Patent and Trademark Office*